US007924245B2

(12) United States Patent
Kim et al.

(10) Patent No.: US 7,924,245 B2
(45) Date of Patent: Apr. 12, 2011

(54) ELECTRO-LUMINESCENCE DISPLAY DEVICE WITH DATA DRIVER CAPABLE OF APPLYING CURRENT AND VOLTAGE SIGNALS AND DRIVING METHOD THEREOF

(75) Inventors: Chang Yeon Kim, Ahnyang-shi (KR); Han Sang Lee, Uiwang-shi (KR); Myung Ho Lee, Uiwang-shi (KR)

(73) Assignee: LG Display Co., Ltd., Seoul (KR)

( * ) Notice: Subject to any disclaimer, the term of this patent is extended or adjusted under 35 U.S.C. 154(b) by 857 days.

(21) Appl. No.: 10/825,365

(22) Filed: Apr. 16, 2004

(65) Prior Publication Data

US 2005/0140598 A1 Jun. 30, 2005

(30) Foreign Application Priority Data

Dec. 30, 2003 (KR) ..... P2003-99806

(51) Int. Cl.
*G09G 3/30* (2006.01)

(52) U.S. Cl. ..... 345/76; 345/82; 315/169.3

(58) Field of Classification Search ..... 345/76, 345/82; 365/189; 315/169.3
See application file for complete search history.

(56) References Cited

U.S. PATENT DOCUMENTS

| | | | | |
|---|---|---|---|---|
| 6,369,786 | B1 * | 4/2002 | Suzuki | 345/77 |
| 6,756,951 | B1 * | 6/2004 | Ishizuka et al. | 345/82 |
| 6,956,547 | B2 * | 10/2005 | Bae et al. | 345/77 |
| 6,965,362 | B1 * | 11/2005 | Ishizuka | 345/82 |
| 7,030,842 | B2 * | 4/2006 | Ha et al. | 345/76 |
| 7,113,156 | B2 * | 9/2006 | Hashimoto | 345/77 |
| 7,126,568 | B2 * | 10/2006 | LeChevalier | 345/84 |
| 2001/0028335 | A1 * | 10/2001 | Hasegawa et al. | 345/76 |
| 2002/0011796 | A1 * | 1/2002 | Koyama | 315/169.1 |
| 2002/0105279 | A1 * | 8/2002 | Kimura | 315/169.3 |
| 2003/0038760 | A1 * | 2/2003 | Kim et al. | 345/76 |
| 2003/0151577 | A1 * | 8/2003 | Morita | 345/89 |
| 2004/0201554 | A1 * | 10/2004 | Satoh | 345/76 |
| 2005/0030264 | A1 * | 2/2005 | Tsuge et al. | 345/76 |

FOREIGN PATENT DOCUMENTS

| | | |
|---|---|---|
| EP | 1 361 561 | * 12/2003 |
| JP | 2003-066908 | 3/2003 |
| JP | 2003-108065 | 4/2003 |
| JP | 2003-114645 | 4/2003 |
| JP | 2003-177909 | 6/2003 |
| WO | WO 03/023752 | 3/2003 |
| WO | WO 03092165 | 11/2003 |
| WO | WO 2004100118 | 11/2004 |

* cited by examiner

*Primary Examiner* — Quan-Zhen Wang
*Assistant Examiner* — Calvin C Ma
(74) *Attorney, Agent, or Firm* — McKenna Long & Aldridge LLP

(57) ABSTRACT

An electro-luminescence display device, including gate lines, data lines crossing the gate lines, pixel cells at crossings of the gate lines and the data lines, a gate driver that sequentially applies a gate signal to the gate lines during one horizontal period, and a plurality of data driving circuits that apply voltage signals to the pixel cells along a gate line during a first time of the horizontal period and applying current signals to the pixel cells during a second time after the first time of the horizontal period.

5 Claims, 9 Drawing Sheets

ELECTRO-LUMINESCENCE DISPLAY DEVICE WITH DATA DRIVER CAPABLE OF APPLYING CURRENT AND VOLTAGE SIGNALS AND DRIVING METHOD THEREOF

This application claims the benefit of Korean Patent Application No. P2003-99806, filed on Dec. 30, 2003, which is hereby incorporated by reference for all purposes as if fully set forth herein.

BACKGROUND OF THE INVENTION

1. Field of the Invention

This invention relates to an electro-luminescence display (ELD), and more particularly to an electro-luminescence display device and a driving method thereof wherein pixel cells are pre-charged by a voltage to thereby display a picture having a desired gray level.

2. Description of the Related Art

Recently, various flat panel display devices with reduced weight and bulk have been developed that eliminate various disadvantages of displays employing cathode ray tubes (CRT). Such flat panel display devices include liquid crystal displays (LCD), field emission displays (FED), plasma display panels (PDP) and electro-luminescence (EL) displays, etc.

The EL display is a self-luminous device capable of causing a phosphorous material to emit light by a re-combination of electrons with holes. There are two types of EL displays depending upon the material and structure used: inorganic and organic. The EL display has the advantage of a CRT in that it has a faster response speed than a passive-type light-emitting device requiring a separate light source like the LCD.

FIG. 1 is a sectional view of a related art organic EL structure to explain the light-emitting principles of the EL display device.

Referring to FIG. 1, the organic EL device of the EL display (ELD) includes an electron injection layer 4, an electron carrier layer 6, a light-emitting layer 8, a hole carrier layer 10' and a hole injection layer 12 that are sequentially disposed between a cathode 2 and an anode 14.

If a voltage is applied between the anode 14, which may be a transparent electrode and the cathode 2, which may be a metal electrode, then electrons produced at the cathode 2 are moved, via the electron injection layer 4 and the electron carrier layer 6, into the light-emitting layer 8, while holes produced at the anode 14 are moved, via the hole injection layer 12 and the hole carrier layer 10, into the light-emitting layer 10. Thus, the electrons and the holes fed from the electron carrier layer 6 and the hole carrier layer 10 collide at the light-emitting layer and recombine to emit light via the transparent electrode (i.e., the anode 14) to thereby display an image.

FIG. 2 shows a related art active matrix type EL display device.

Referring to FIG. 2, the related art active matrix type EL display device includes an EL display panel 16 with pixel (PE) cells 22 arranged at each crossing between gate electrode lines GL and data electrode lines DL, a gate driver 18 that drives the gate electrode lines GL, a data driver 20 that drives the data electrode lines DL, and a timing controller 24 that controls the gate driver 18 and the data driver 20.

The timing controller 24 controls the data driver 20 and the gate driver 18. The timing controller 24 applies various control signals to the data driver 20 and the gate driver 18.

Further, the timing controller 24 re-aligns data and supplies the aligned data to the data driver 20.

The gate driver 18 sequentially applies a gate signal to the gate electrode lines GL under the control of the timing controller 24.

The data driver 20 applies video signals to the data electrode lines DL under the control of the timing controller 24. The data driver 20 applies one horizontal line of a video signal at a time to the data electrode lines DL once every horizontal synchronization period (H) when a gate signal is applied.

The PE cells 22 generate light corresponding to the video signals (i.e., current signals) applied to the data electrode lines DL to thereby display an image corresponding to the video signals. As shown in FIG. 3, each PE cell 22 includes a light-emitting cell driving circuit 30 to drive a light-emitting cell organic light emitting diode (OLED) in response to a driving signal supplied from each of the data electrode lines DL and the gate electrode lines GL, and a light-emitting cell OLED connected between the light-emitting cell driving circuit 30 and the ground voltage source GND.

The light-emitting cell driving circuit 30 includes a first driving thin film transistor (TFT) T1 connected between the supply voltage line VDD and the light-emitting cell OELD, a first switching TFT T3 connected between the gate electrode line and the data electrode line DL, a second driving TFT T2 connected between the first switching TFT T3 and the supply voltage line VDD to form a current mirror circuit with respect to the driving TFT T1, a second switching TFT T4 connected between the gate electrode line GL and the second driving TFT T2, and a storage capacitor Cst connected between a node positioned between the first and second driving TFTs T1 and T2 and the supply voltage line VDD. By way of example, the TFTs are a p-type electron metal-oxide semiconductor field effect transistor (MOSFET).

A gate terminal of the first driving TFT T1 is connected to the gate terminal of the second driving TFT T2; a source terminal thereof is connected to the supply voltage line VDD; and a drain terminal thereof is connected to the light-emitting cell OLED. A source terminal of the second driving TFT T2 is connected to the supply voltage line VDD, and a drain terminal thereof is connected to a drain terminal of the first switching TFT T3 and a source terminal of the second switching TFT T4.

A source terminal of the first switching TFT T3 is connected to the data electrode line DL, and a gate terminal thereof is connected to the gate electrode line GL. A drain terminal of the second switching TFT T4 is connected to the gate terminals of the first and second driving TFTs T1 and T2 and the storage capacitor Cst. A gate terminal of the second switching TFT T4 is connected to the gate electrode line GL.

Herein, the first and second driving TFTs T1 and T2 are connected to each other in such a manner to form a current mirror. Thus, assuming that the first and second driving TFTs T1 and T2 have the same channel width, a current flowing in the first driving TFT T1 is set to be equal to a current flowing in the second driving TFT T2.

The operation of the light-emitting cell driving circuit 30 will be described below.

First, a gate signal is applied from the gate electrode line GL to a group of PE cells 22 along a horizontal line. When the gate signal is applied, the first and second switching TFTs T3 and T4 are turned on. When the first and second switching TFTs T3 and T4 are turned on, a video signal from the data electrode line DL is applied, via the first and second switching TFTs T3 and T4, to the gate terminals of the first and second driving TFTs T1 and T2. The first and second driving TFTs T1 and T2 supplied with the video signal are turned on. Herein, the first driving TFT T1 controls a current flowing from its source terminal (i.e., VDD) into its drain terminal in response to the video signal applied to its gate terminal to apply this current to the light-emitting cell OLED, thereby resulting in the light-emitting cell OLED emitting light having a brightness corresponding to the video signal.

At the same time, the second driving TFT T2 applies a current id fed from the supply voltage line VDD, via the first switching TFT T3, to the data electrode line DL. Because the first and second driving TFTs T1 and T2 form a current mirror circuit, the same current flows in the first and second driving TFTs T1 and T2. Meanwhile, the storage capacitor Cst stores a voltage from the supply voltage line VDD corresponding to the current id flowing into the second driving TFT T2. Further, the storage capacitor Cst turns on the first driving TFT T1 using a voltage stored therein when the gate signal becomes an OFF signal to turn off the first and second switching TFTs T3 and T4, thereby applying a current corresponding to the video signal to the light-emitting cell OEL.

Herein, the related art driver 20 applies a desired current to the PE cell 22 in correspondence with data from the timing controller 24. In other words, the related art data driver 20 drives the PE cells 22.

The related art data driver 20 includes a plurality of data driving integrated circuits (IC's), each of which is configured as shown in FIG. 4.

Referring to FIG. 4, the data driver 20 includes a shift register 40, a first latch 42, a second latch 44 and a current driver 46.

The shift register 40 sequentially shifts a source start pulse SSP from the timing controller 24 in response to a source sampling clock SSC to thereby output a sampling signal.

The first latch 42 sequentially samples data from the timing controller 24 for each data line in response to the sampling signal from the shift register 40 and latches the sampled data. The first latch 42 includes i latches (wherein i is an integer corresponding to the number of data lines) for latching i image data, each of which has a certain number of data bits. The image data stored in the first latch 42 is then supplied to the second latch 44.

The second latch 44 temporarily stores the image data from the first latch 42 and simultaneously outputs the stored image data in response to a source output enable signal SOE from the timing controller 24.

The current driver 46 produces a current to be applied to the PE cell 22 corresponding to the data received from the second latch 44. This will be described with reference to FIG. 5. The current driver 46 includes i current driving blocks 48 for each data line. The current driving block 48 receives data from the second latch 44 and produces a current id corresponding to the data using a gamma current signal corresponding to the received data. Thus, a current id corresponding to a desired video signal is applied to each of the data lines DL, thereby displaying a desired image corresponding to the image data.

As described above, the related art EL display device drives the PE cell 22 only with a current. However, if the PE cell 22 is driven only with a current, then a problem arises in that certain desired gray levels are unable to be displayed. In other words, the conventional EL display device supplies a current value changing in increments on the order of about a μA in correspondence with a data. For instance, the data driving IC allows a current of 1 μA to flow at a gray level 1 while allowing a current of 2 μA to flow at a gray level 2. However, if such a current value that changes at a μA level is applied during one horizontal period (H), then a voltage corresponding to the current fails to be charged in the storage capacitor Cst. In other words, the storage capacitor Cst fails to be charged with a voltage corresponding to the current within a limited time (H) because the PE cell 22 is driven only with a current, and hence a problem arises in that a desired gray level of picture fails to be displayed.

SUMMARY OF THE INVENTION

Accordingly, the present invention is directed to an electro-luminescence display device and driving method thereof that substantially obviates one or more of the problems due to limitations and disadvantages of the related art.

An advantage of the present invention is to provide a current and voltage signal to a OLED pixel element.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an electro-luminescence display device, including gate lines, data lines crossing the gate lines, pixel cells at crossings of the gate lines and the data lines, a gate driver that sequentially applies a gate signal to the gate lines during one horizontal period, and a plurality of data driving circuits that apply voltage signals to the pixel cells along a gate line during a first time of the horizontal period and applying current signals to the pixel cells during a second time after the first time of the horizontal period.

In another aspect of the present invention, a method of driving an electro-luminescence display device, including applying a gate signal to pixel cells along a specific horizontal line during a horizontal period, applying a voltage value corresponding to image data to the pixel cells during a first time to pre-charge the pixel cells, and applying a current value corresponding to the image data to the pixel cells during a second time after the first time to display an image corresponding to the image data.

In another aspect of the present invention, a method of driving an electro-luminescence display device, including applying a gate signal from a gate driver during each horizontal period to select pixel cells along specific horizontal line, applying a voltage value corresponding to image data from a voltage driver to the pixel cells during a first time of the horizontal period; and applying a current value corresponding to the image data to the pixel cells during a second time after the first time.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to an embodiment of the present invention, example of which is illustrated in the accompanying drawings.

Figure 6:
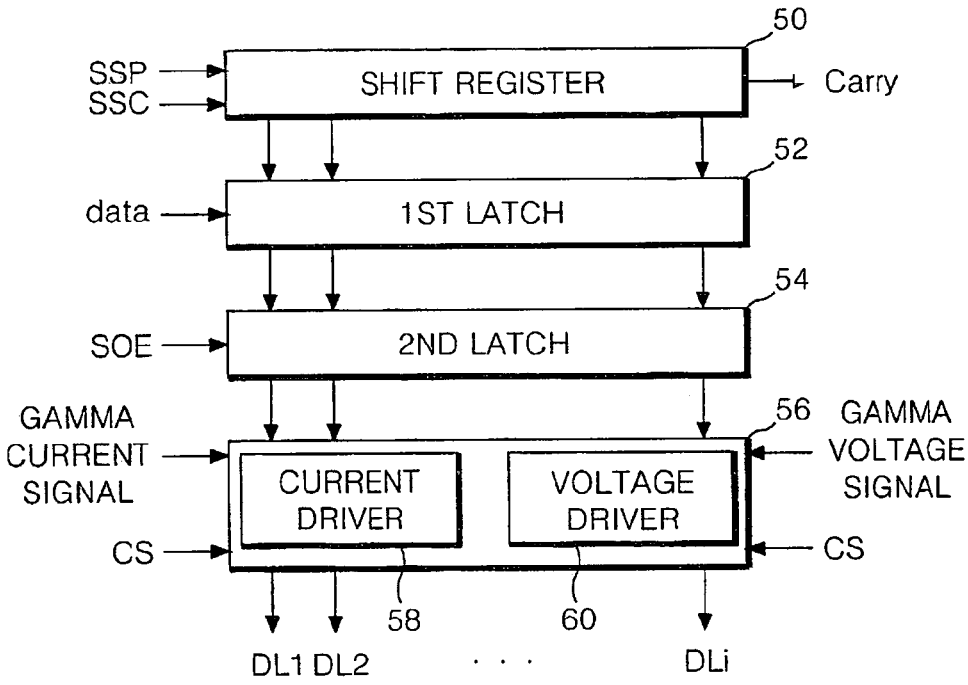
FIG. 6 is a block diagram showing a configuration of a data driving integrated circuit according to an embodiment of the present invention.

FIG. 6 shows a data driving integrated circuit (IC) according to an embodiment of the present invention for a data driver of an EL display device.

In FIG. 6, the data driver IC according to the embodiment of the present invention includes a shift register 50, a first latch 52, a second latch 54 and a current driver 56.

The shift register 50 sequentially shifts a source start pulse SSP from the timing controller in response to a source sampling clock SSC to thereby output a sampling signal. Herein, the shift register 50 includes i shift registers for the purpose of outputting i sampling signals when the data driving IC has i channels (wherein i is an integer).

The first latch 52 sequentially samples a image data from the timing controller for each data line in response to the sampling signal from the shift register 50 and latches the sampled data. The first latch 52 includes i latches for latching i image data, each of which has a certain number of data bits. The image data stored in the first latch 52 is then supplied to the second latch 54.

The second latch 54 temporarily stores the image data from the first latch 52 and simultaneously outputs the stored image data in response to a source output enable signal SOE from the timing controller.

The driver 56 applies one of a current signal and a voltage signal to the data lines DL in response to a control signal CS from the timing controller. When a current signal is applied to the data lines DL, a current flows from the PE cell into the driver 56. On the other hand, when a voltage signal is supplied to the data lines DL, it is also applied to the PE cell to pre-charge the PE cell.

To this end, the driver 56 includes a current driver 58 and a voltage driver 60. The current driver 58 produces a current corresponding to data from the second latch that flows from the PE cell 22, thereby displaying an image corresponding to the data at the PE cell. The voltage driver 60 applies a voltage corresponding to the data from the second latch to the PE cell, thereby pre-charging a voltage value corresponding to the data into the PE cell.

The voltage driver 60 receives a gamma voltage signal from a gamma voltage driver (not shown). Specifically, the gamma voltage part applies a plurality of gamma voltage signals having different voltage values to the voltage driver 60, and the voltage driver 60 selects a gamma voltage signal corresponding to the data from the second latch 54 from the plurality of gamma voltage signals, and applies the selected gamma voltage to the data lines DL.

Figure 7:
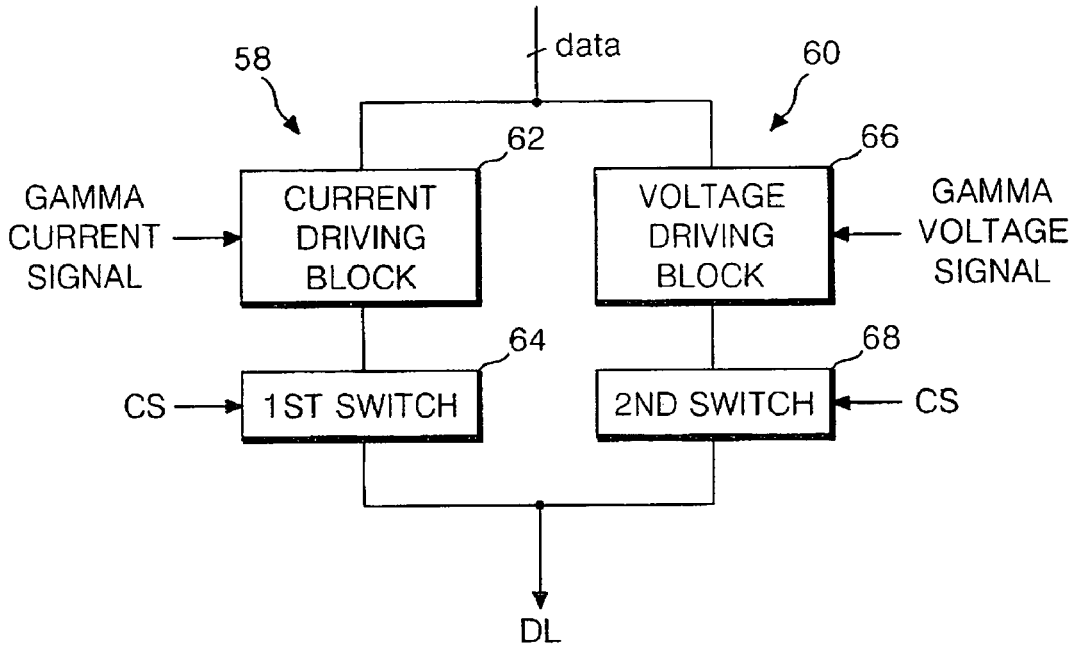
FIG. 7 is a block diagram of the current driver and the voltage driver shown in FIG. 6.

Meanwhile, as shown in FIG. 7, the current driver 58 includes i current driving blocks 62, where i is the number of data lines DL, and a first switching device 64. The driving blocks 62 are connected, via the first switching device 64, to the data lines DL. Further, as shown in FIG. 7, the voltage driver 60 includes i voltage driving blocks 66 and a second switching device 68. The voltage driving blocks 66 are connected, via the second switching device 68, to the data lines DL.

The current driving block 62 selects a gamma current signal corresponding to the data supplied from the second latch 54, and allows a current corresponding to the data flow from the PE cell using the selected gamma current signal. The voltage driving block 66 selects one of a plurality of gamma voltage signals from the gamma voltage driver corresponding to the data from the second latch 54 and applies the selected gamma voltage signal to the data lines DL to pre-charge the PE cell.

The first switching device 64 electrically connects the data line DL with the current driving block 62 in response to a first polarity (e.g., a low state) of the control signal CS. A desired current value flows in the data line DL under control of the current driving block 62. The second switching device 68 electrically connects the data line DL with the voltage driving block 66 in response to a second polarity (e.g., a high state) of the control signal CS. At this time, a desired voltage value is applied to the data line DL under control of the current driving block 66.

Figure 8:
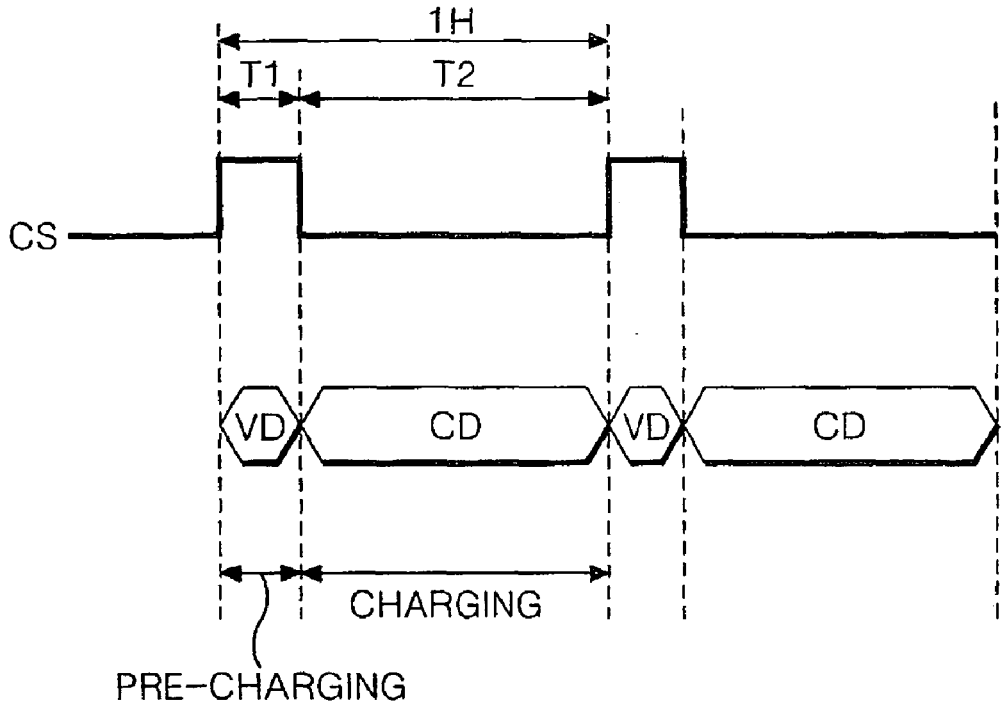
FIG. 8 depicts a polarity of the control signal shown in FIG. 7.

As shown in FIG. 8, the control signal CS has a high state and a low state in one horizontal period (H). During a first time T1 when the control signal CS has the second polarity (i.e., high state), the second switching device 68 is turned on to thereby apply a gamma voltage signal corresponding to the data from the second latch 54 to the data lines DL. As a result, the PE cells are pre-charged with a gamma voltage valve VD corresponding to the data. Further, during a second time T2 when the control signal CS has the first polarity (i.e., low state), the first switching device 64 is turned on, thereby allowing a current value corresponding to the data to flow into the data lines DL. Also, the PE cells are pre-charged to a voltage value corresponding to the data, and an image corresponding to the data is displayed.

The first time T1 may be set to be shorter than the second time T2. In other words, in this embodiment of the present invention, a voltage value is pre-charged into the PE cell during the first time T1, which is a small portion of the horizontal period (H) while a current is applied to the PE cell during the second time T2, which is a large portion of the horizontal period (H), thereby pre-charging a desired voltage into the PE cell and displaying an image corresponding to the data.

Figure 1:
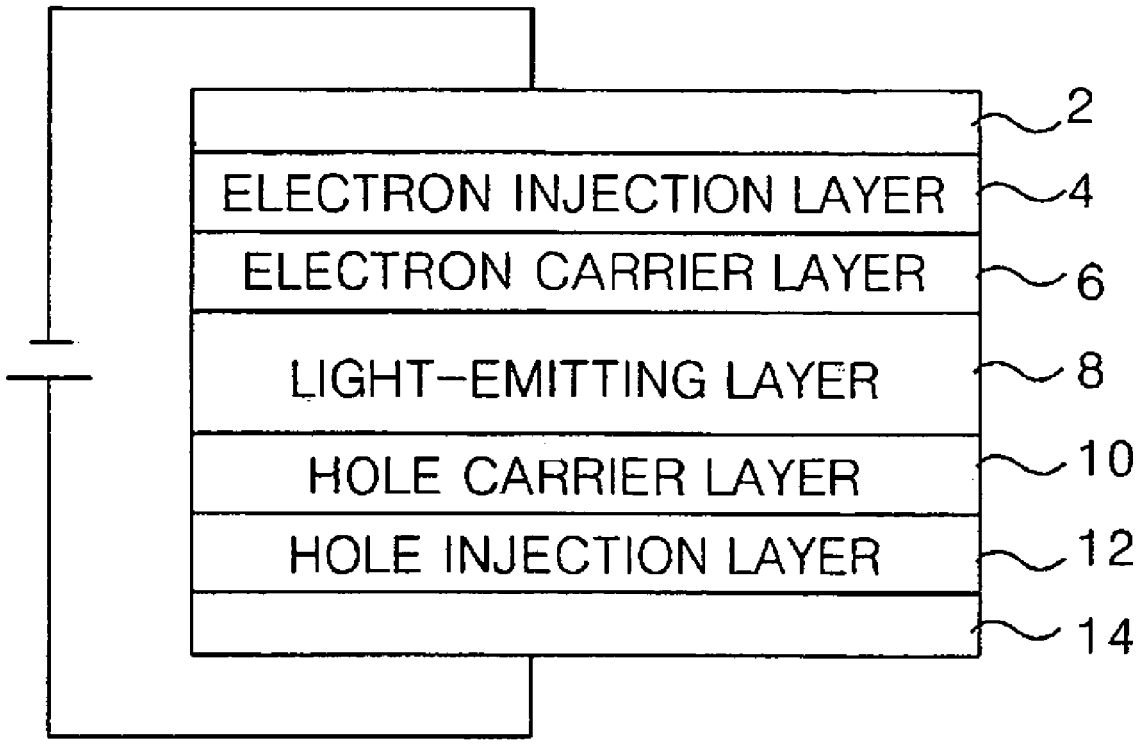
FIG. 1 RELATED ART
FIG. 1 is a schematic section view showing a structure of an organic light-emitting cell in a general electro-luminescence display panel according to the related art.
Figure 2:
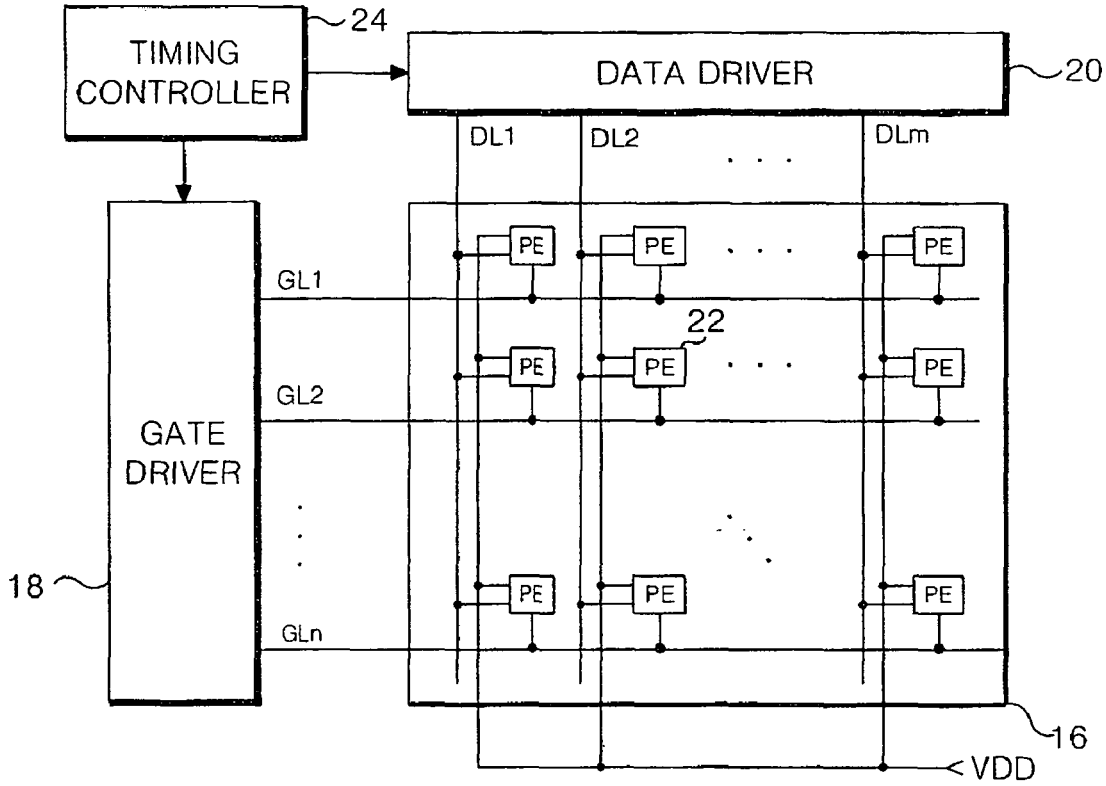
FIG.2 RELATED ART
FIG. 2 is a block diagram showing a configuration of a related art electro-luminescence display panel.
Figure 3:
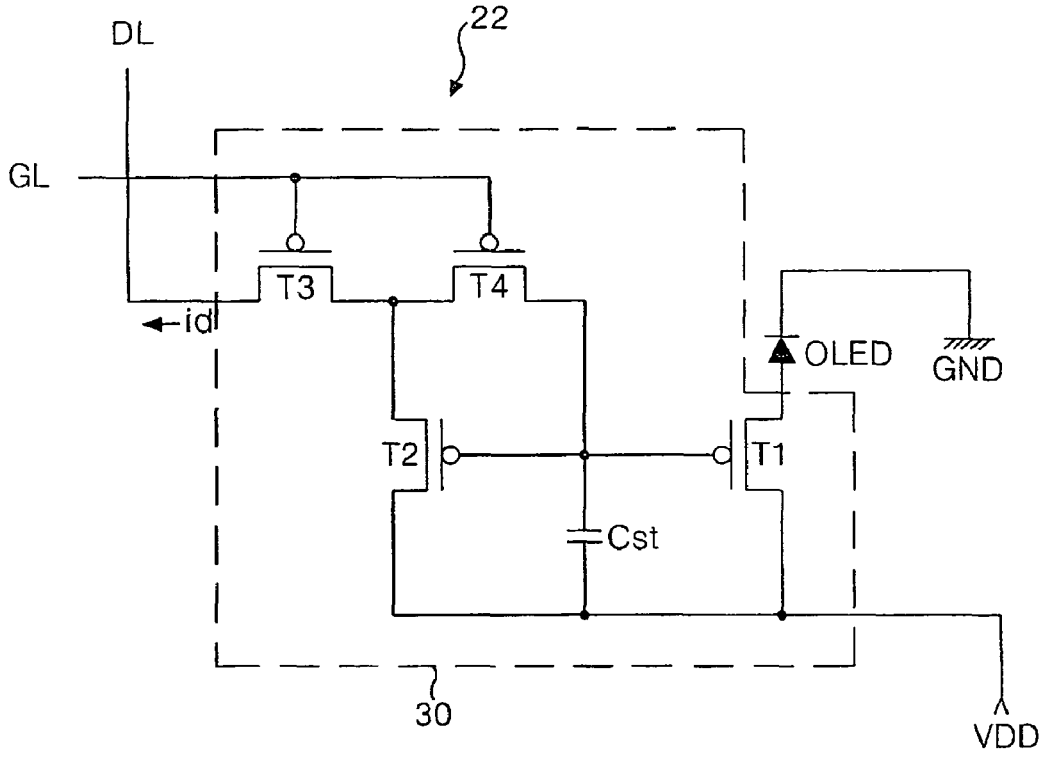
FIG.3 RELATED ART
FIG. 3 is an equivalent circuit diagram of each pixel cell PE shown in FIG. 2.
Figure 4:
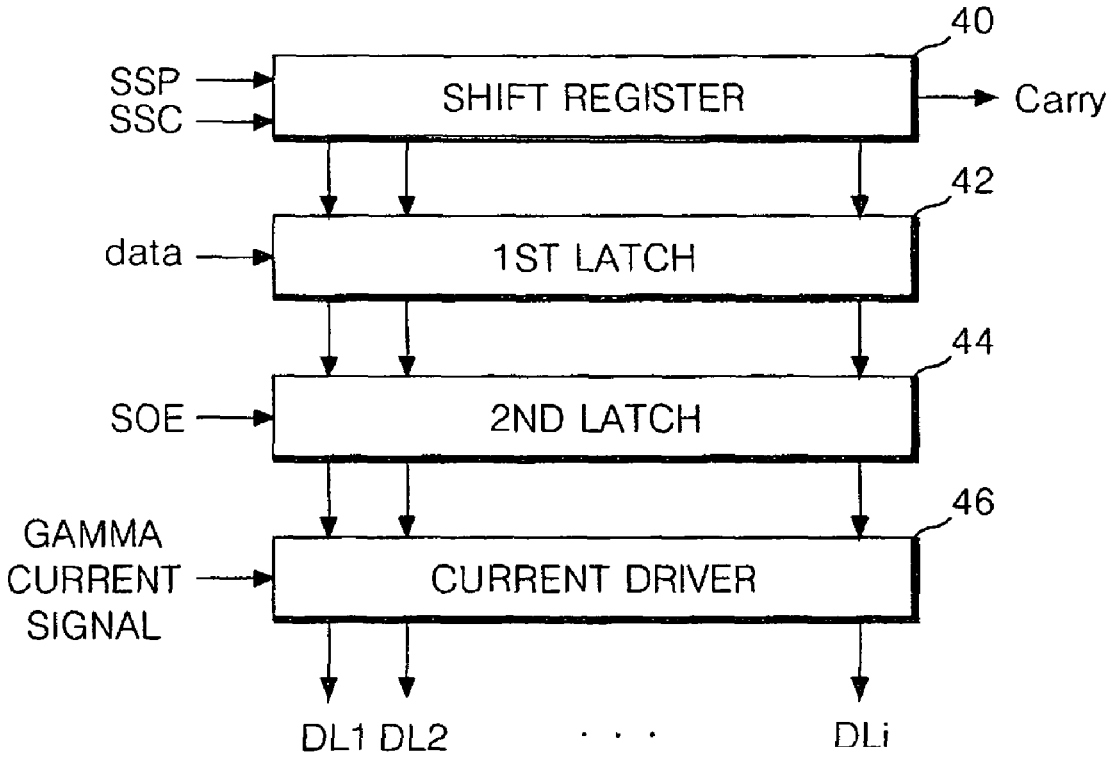
FIG. 4 RELATED ART
FIG. 4 is a block diagram showing a configuration of a data driving integrated circuit included in the data driver shown in FIG. 3 according to the related art.
Figure 5:
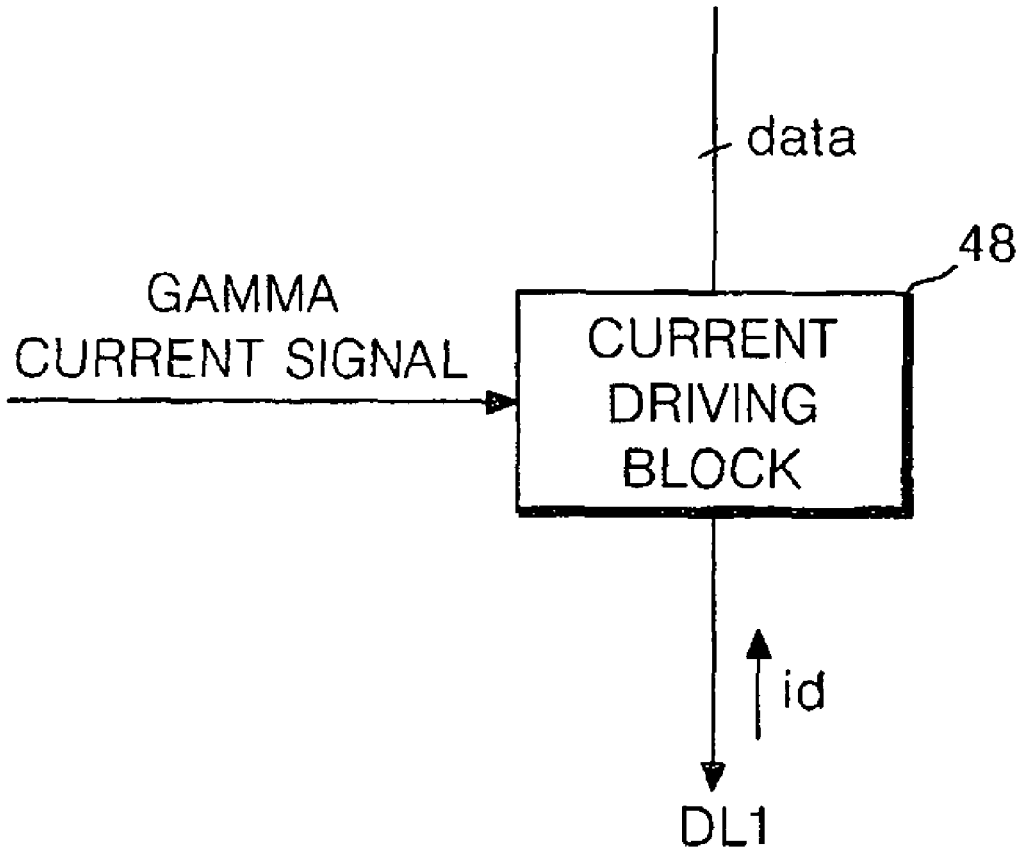
FIG. 5 RELATED ART
FIG. 5 is a block diagram of the current driver shown in FIG. 4 according to the related art.
Figure 9:
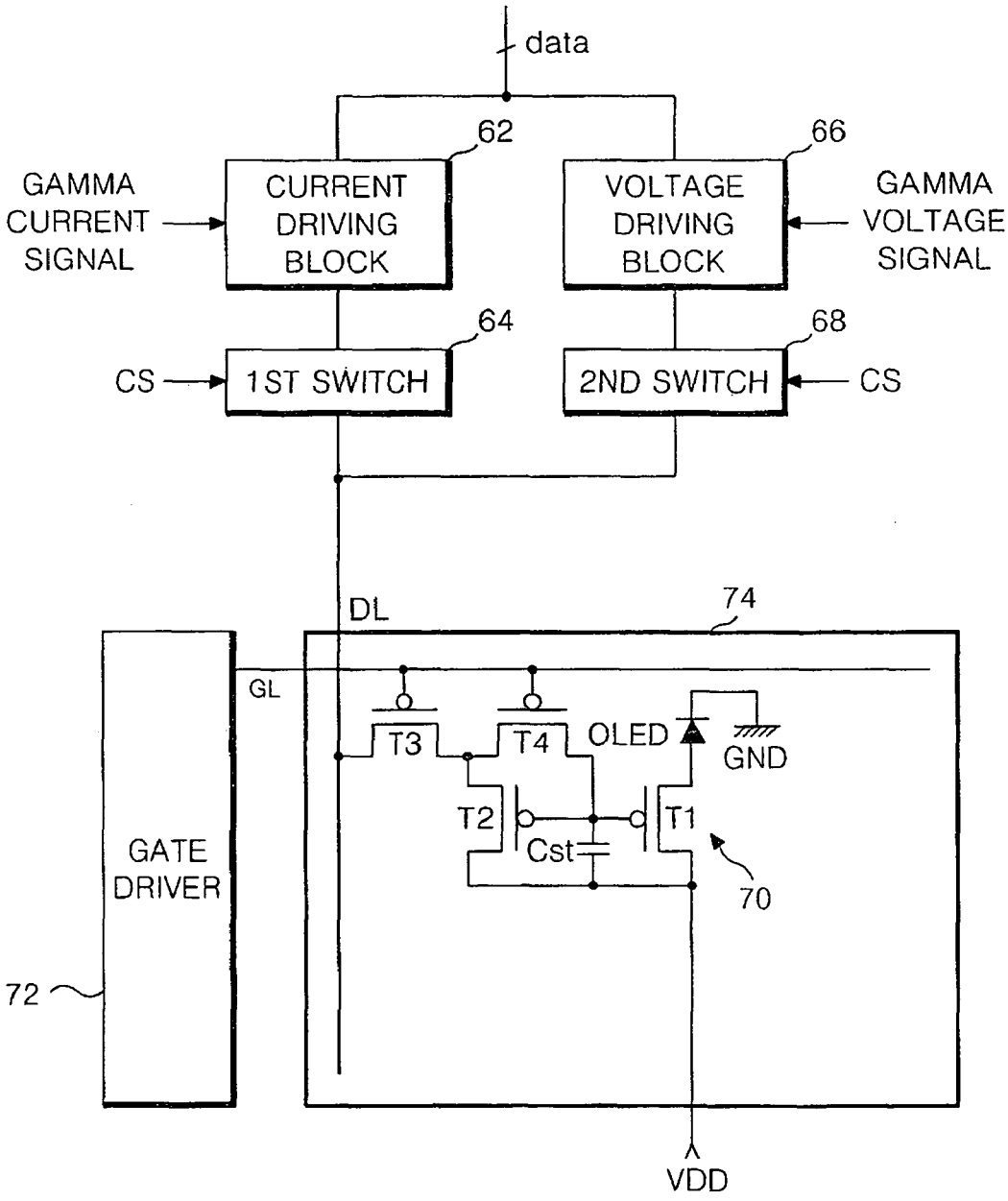
FIG. 9 is a block diagram showing a configuration of the current driver and the voltage driver connected to the pixel cell.

The operation of the EL display device according to this embodiment of the present invention will be described in detail with reference to FIG. 9. First, a gate signal is supplied from a gate driver 72 to select the PE cells 70 along a specific horizontal line. Because the configuration of the PE cell 70 is identical to that in FIG. 3, its operation was previously explained. When a gate signal is applied, the first and second switching TFTs T3 and T4 are turned on.

As shown in FIG. 8, during an initial time of one horizontal period (H), that is, the first time T1, the second switching device 68 is turned on. Thus, a gamma voltage signal corresponding to the data is supplied from the voltage driving block 66 to the data line DL. Because the first and second switching TFTs T3 and T4 have been turned on, the gamma voltage signal is charged, via the first and second switching TFTs T3 and T4, onto the storage capacitor Cst. In other words, during the first time T1, a voltage value corresponding to the data is pre-charged onto the storage capacitor Cst.

Next, during the second time T2, the second switching device 68 is turned off while the first switching device 64 is turned on. In other words, the first and second switching devices 64 and 68 are alternately turned on. When the first switching device 64 is turned on, the current driving block 62 is electrically connected, via the first switching device 64, to the data line DL and the first and second switching TFTs T3 and T4 and to the gate terminals of the first and second driving TFTs T1 and T2. As a result, the first and second driving TFTs T1 and T2 are turned on. When the second driving TFT T2 is turned on, a current from the supply voltage line VDD is applied, via the first switching TFT T3, to the current driving block 62. This results in a current flowing via the first switching TFT T3 that is determined by the gamma current signal selected in response to the data inputted to the current driving block 62.

Because the first and second driving TFTs T1 and T2 form a current mirror circuit, the same current flows into the first driving TFT T1. Thus, the light-emitting cell OLED emits light having a brightness corresponding to the current supplied from the first driving TFT T1, to thereby display a desired image on the panel 74. Further, a desired voltage is stored in the storage capacitor Cst in such a manner so as to correspond to a current amount flowing into the second driving TFT T2. Because the storage capacitor Cst has been pre-charged with a data voltage during the first time T1, it is charged with a sufficient voltage corresponding to the current amount. Further, when a gate signal is inverted into an OFF signal to turn off the first and second switching TFTs T3 and T4, the storage capacitor Cst turns on the first driving TFT T1 using the voltage stored therein, thereby applying a current corresponding to the video signal to the light-emitting cell OLED.

In other words, the present EL display device charges the PE cell 70 using a voltage value during a pre-charging interval that is a portion of one horizontal period (H), thereby charging a voltage value corresponding to the data into the PE cell 70. Next, the EL display device allows a current value corresponding to the data to flow into the PE cell 70 during the remaining interval of one horizontal period (H), thereby sufficiently charging an accurate voltage value corresponding to the data into the PE cell 70. Accordingly, the EL display device according to the embodiment of the present invention can display an image having a desired gray level and thus improve image quality.

As described above, according to the present invention, a voltage value is applied to the pixel cells during an initial interval of one horizontal period when a gate signal is applied to pre-charge the pixel cells. Further, a current value corresponding to the data can flow from the pixel cell during the remaining interval of one horizontal period, and thus an accurate voltage value corresponding to the data is pre-charged into the pixel cells. Accordingly, the pixel cells are pre-charged with the aid of a voltage value, thereby generating light having a gray level value corresponding to the data from the pixel cells and thus improving image quality.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An electro-luminescence display device, comprising:

gate lines;

data lines crossing the gate lines;

pixel cells at crossings of the gate lines and the data lines;

a gate driver that sequentially applies a gate signal to the gate lines during one horizontal period;

a gamma driver that generates a plurality of gamma voltage signals corresponding to image data and a plurality of gamma current signals corresponding to the image data; and a plurality of data driving circuits that apply the plurality of gamma voltage signals to the pixel cells along the data lines during a first time within the horizontal period and applying current signals corresponding the plurality of gamma current signals to the pixel cells along the data lines during a second time within the horizontal period after the first time of the horizontal period, wherein each of the plurality of data driving circuits includes a voltage driver, wherein the voltage driver includes:

a voltage driving block configured to apply the gamma voltage signal, and a first switch connected between the voltage driving block and a corresponding data line and turned on by the first level of a control signal during the first time of the horizontal period to pre-charge the gamma voltage signal onto storage capacitors in the pixel cells via the corresponding data line, and wherein the current driver includes:

a current driving block configured to apply a gamma current signal, and a second switch connected between the current driving block and the corresponding data line, and turned on by the second level of the control signal during the second time of the horizontal period to apply the gamma current signal to the storage capacitors in the pixel cells via the corresponding data line.

2. The electro-luminescence display device according to claim 1, wherein the first time is shorter than the second time.

3. The electro-luminescence display device according to claim 1, wherein the control signal remains at a first level during the first time and remaining at second level during the second time.

4. A method of driving an electro-luminescence display device, comprising:

applying a gate signal from a gate driver during each horizontal period to select pixel cells along specific horizontal line;

generating a plurality of gamma voltage signals corresponding to image data and a plurality of gamma current signals corresponding to the image data;

applying the plurality of gamma voltage signals to data lines via first switches which are turned on by a first level of a control signal during a first time within the horizontal period to pre-charge the plurality of gamma voltage signals onto storage capacitors of the pixel cells; and applying the plurality of gamma current signals to the data lines via second switches which is turned on by a first level of the control signal during a second time within the horizontal period after the first time.

5. The method according to claim 4, wherein the first time is less than the second time.

* * * * *